United States Patent [19]

Searcy

[11] 4,256,181

[45] Mar. 17, 1981

[54] AUTOMATIC STOVE TOP FIRE EXTINGUISHER

[76] Inventor: Charles C. Searcy, P.O. Box 23, Wauchula, Fla. 33873

[21] Appl. No.: 936,859

[22] Filed: Aug. 25, 1978

[51] Int. Cl.[3] ..... A62C 13/24

[52] U.S. Cl. ..... 169/65; 219/517; 337/150

[58] Field of Search ..... 169/65, 59, 47, 28, 169/19, 26, 28, 42, 60, 65; 219/517, 510; 337/150

[56] References Cited

U.S. PATENT DOCUMENTS

| | | | |
|---|---|---|---|
| 2,383,048 | 8/1945 | Eckert, Jr. | 169/28 |
| 3,824,374 | 7/1974 | Mayher | 169/65 |
| 3,889,757 | 6/1975 | Dunn | 169/65 |
| 3,897,828 | 8/1975 | Glover | 169/65 |

FOREIGN PATENT DOCUMENTS

| | | | |
|---|---|---|---|
| 422557 | 1/1935 | United Kingdom | 169/59 |

*Primary Examiner*—Robert J. Spar
*Assistant Examiner*—Kenneth Noland
*Attorney, Agent, or Firm*—Duckworth, Hobby, Allen & Pettis

[57] ABSTRACT

A fire extinguishing system is automatically actuated in response to flames from a fire on the upper surface of a stove having a vent hood. A pressurized fire extinguisher includes a lever actuated valve spring biased to the open position and contains a supply of fire extinguishing material. A discharge manifold extends between the valve of the fire extinguisher and a plurality of nozzles which are positioned within the vent hood to distribute the fire extinguishing material over the upper surface of the stove when the valve is released into the open position. A fusible link secures a strut which maintains the valve in a closed position. A fuse extends from an area above the upper surface of the stove to a capsule of gun powder which surrounds the fusible link. A fire in the stove top area ignites the exposed end of the fuse which controllably transfers fire to the capsule of gun powder. Combustion of the gun powder instantaneously severs the fusible link which releases the strut and permits the spring to open the valve of the fire extinguisher causing the entire contents of the fire extinguisher to be discharged onto the stove top area.

5 Claims, 4 Drawing Figures

AUTOMATIC STOVE TOP FIRE EXTINGUISHER

BACKGROUND OF THE INVENTION

1. Field of the Invention

The present invention is related to fire extinguishing apparatus, and in particular, to automatically actuated stove top fire extinguishing systems.

2. Description of the Prior Art

Numerous different types of systems have been developed to automatically extinguish grease and other types of fires originating on the top of stove type cooking appliances. U.S. Pat. No. 3,448,808 (Scofield) discloses an automatically actuated fire extinguishing system having a remotely located pressurized cylinder of fire extinguishing material, a plurality of nozzles for discharging fire extinguishing material onto the top of the stove, and a cord including a plurality of fusible links extending throughout the vent hood above the stove. The valve of the fire extinguisher is maintained in the closed position by the tension exerted thereon by the cord. When any one of the fusible links positioned throughout the system is severed by a fire, the tension force from the cord is released which permits the valve of the fire extinguisher to be opened and its contents to be discharged. U.S. Pat. No. 3,772,499 (Fritzche) discloses a fire extinguishing system which not only discharges fire extinguishing material onto a fire, but which also de-energizes the cooking device causing the fire to prevent reoccurence of the fire. This system utilizes fusible links positioned directly adjacent to potential fire areas. The fusible link is severed by the flames from the fire causing the fire to be extinguished and the cooking apparatus to be de-energized. U.S. Pat. No. 3,283,827 (Diehl) discloses a manually controlled carbon dioxide fire extinguisher system including a fan for drawing the carbon dioxide up the ventilator duct of the vent hood. This system must be manually actuated after a fire has been observed.

U.S. Pat. No. 3,653,433 (Doskery) discloses an electrically actuated fire extinguishing system including a solenoid and a thermostat for extinguishing stove top fires. U.S. Pat. No. 3,584,688 (Doncan) discloses an automatically actuated fire extinguishing system positioned above a deep fat fryer. This system is actuated when flames severe a fusible link releasing the pressure on a normally opened valve in a fire extinguisher causing it to discharge its contents. This system includes apparatus for automatically reducing the flow rate of fire extinguishing material and for causing a flow of fire extinguishing material for a predetermined time in order to prevent reoccurrence of a fire immediately after the fire has been extinguished.

U.S. Pat. No. 3,773,111 (Dunn) discloses an automatic stove top fire extinguishing system having a cylindrical container filled with a fire extinguishing powder. A pyrotechnic fuse is positioned in the lower portion of the vent hood above the cooking surface of the stove. When the fuse is ignited it discharges a pressurized aerosal container causing a piston to be displaced within the cylinder of the fire extinguisher. The increased pressure on the fire extinguishing powder opens a plurality of holes in a sealed nozzle causing the fire extinguishing powder to be discharged onto the fire.

U.S. Pat. Nos. 3,884,307 and 3,884,306 (Williams) disclose fuse actuated fire extinguishers which when activated by fire release the powdered fire extinguishing material from the unit and permit it to fall by gravity onto the fire.

U.S. Pat. No. 3,463,233 (Haessler) discloses a method of producing a soap foam for extinguishing fires in deep fat fires. Another type of foam generating fire extinguisher is disclosed in U.S. Pat. No. 3,356,148 to Jamison.

SUMMARY OF THE INVENTION

The present invention contemplates pyrotechnic sensor means remotely positioned from a fire extinguisher having a normally closed valve which is biased to the open position but maintained in the open position by a fusible link. When the pyrotechnic sensor means is ignited by the flames emanating from a fire, it controllably transfers the fire to the fusible link. When the fusible link is severed the valve on the fire extinguisher is biased to the open position. The fire extinguishing material is discharged through a manifold into the remotely located area in which the pyrotechnic sensor means is positioned.

Am important aspect of the present invention is that a conventional reusable fire extinguisher can readily be modified to be automatically actuated when a fire is detected.

DESCRIPTION OF THE DRAWINGS

The invention is pointed out with particularity in the appended claims. However, other objects and advantages together with the operation of the invention, may be better understood by reference to the following detailed description taken in connection with the following illustrations wherein:

DESCRIPTION OF THE PREFERRED EMBODIMENT

Figure 1:
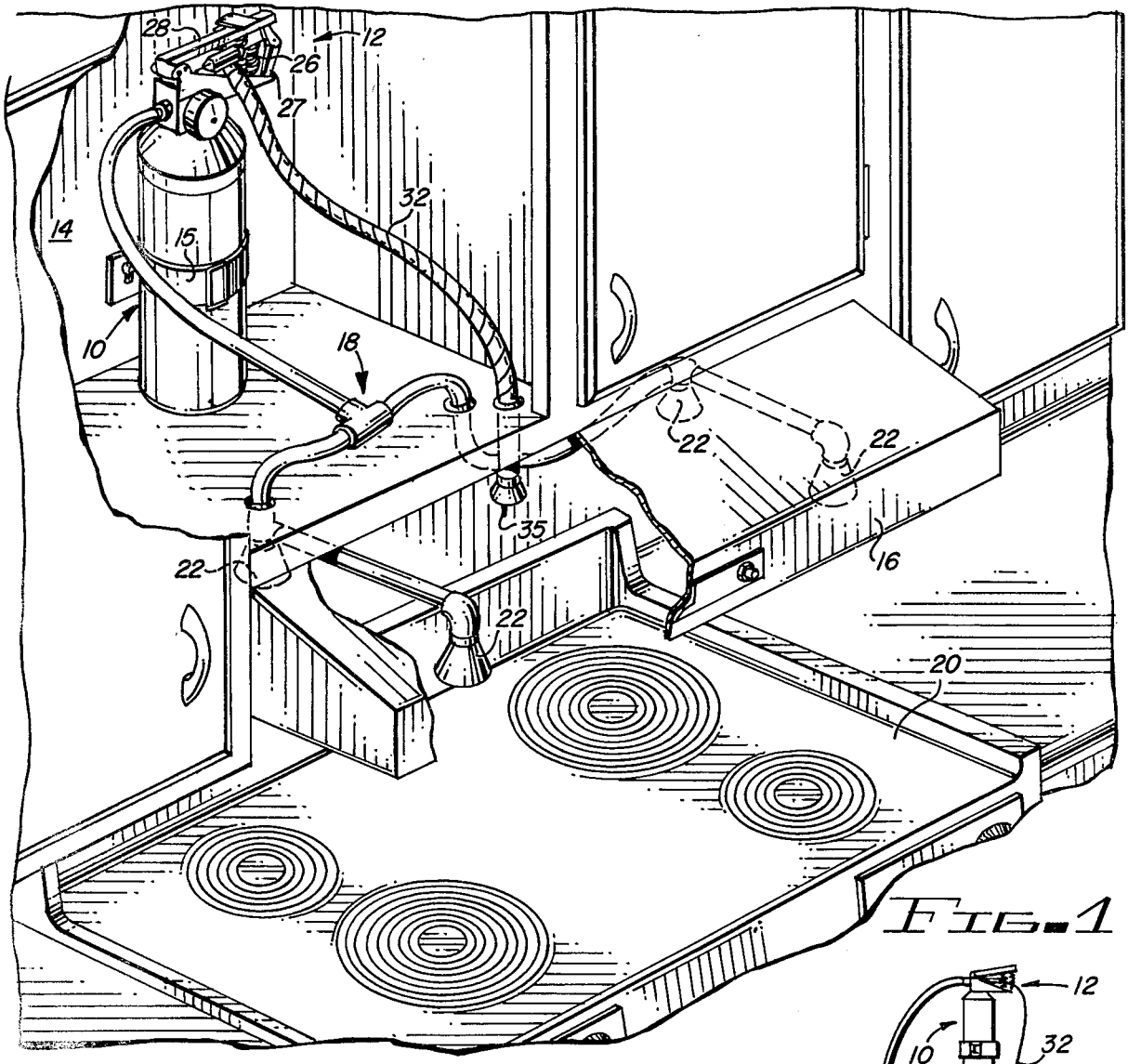
FIG. 1 is a partially cut away perspective view of a fire extinguishing system of the present invention positioned above a stove having a vent hood.
Figure 3:
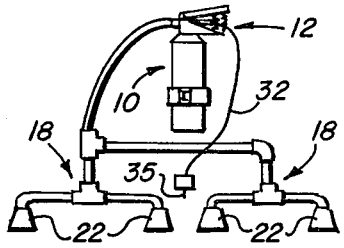
FIG. 3 is a schematic representation of the components of the present invention.

In order to better illustrate the advantages of the invention and its contribution to the art, a preferred hardware embodiment of the invention will now be described in some detail. Referring now to FIGS. 1 and 3, the automatic stove top fire extinguisher includes a pressurized container 10 of fire extinguishing material. A fire extinguisher having a 5BC rating is utilized in the preferred embodiment. Fire extinguisher 10 includes a lever actuated valve 12 having a normally closed position and an open position. The valve is spring biased to the closed position by springs 26 which are secured to the lever arms 28 of valve 12.

The body of fire extinguisher 10 is coupled by a mounting strap to the interior wall 14 of the cabinet section to which the vent hood 16 is secured. Vent hood 16 is typically positioned directly above the upper surface of a gas fired or electrically heated stove 20.

A multi-element discharge manifold 18 is coupled to valve 12 and includes a plurality of nozzles 22 which are positioned within vent hood 16.

One end of a fusible link 24 such as a nylon cord is coupled to clip 23 which is secured to valve 12 while its other end is coupled to toggle bolt 27. Toggle bolt 27 is maintained in position by link 24 and serves to maintain valve 12 in the closed position to oppose the forces exerted on valve 12 by biasing means on spring 26.

Figure 2:
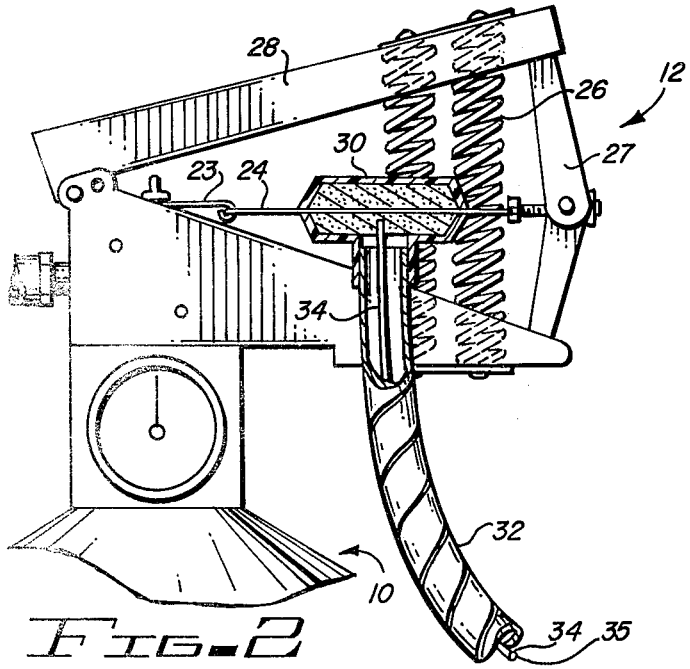
FIG. 2 is an enlarged view, partially cut away, of the system illustrated in FIG. 1.

Referring also now to FIG. 2, a plastic container 30 of flammable material surrounds fusible link 24. Typically a flammable material such as gun powder is positioned within the interior of container 30. A flexible conduit 32 extends from container 30 to an area within vent hood 16. A powder loaded fuse 34 penetrates into the interior of container 30 and extends through conduit 32 into an area within vent hood 16. An end of fuse 34 extends beyond conduit 32 into the area below vent hood 16.

Figure 4:
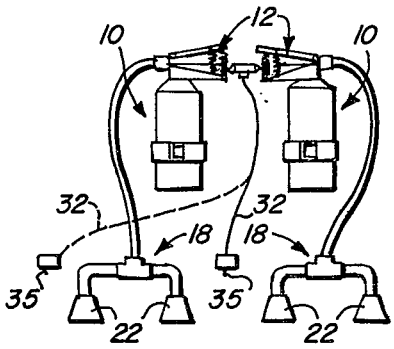
FIG. 4 is a schematic representation of a system of the present invention incorporating two separate fire extinguishers.

FIG. 4 illustrates an additional embodiment of the present invention which includes two fire extinguishers 10 and either one or two conduits 32 each of which includes a section of fuse 34. Ignition of the fuse within either of these conduits will cause the system to be actuated and both of the fire extinguishers to be discharged.

When the flames from a fire on the surface of stove 20 reach the tip 35 of fuse 34 or are drawn to the tip of the fuse by the circulation caused by a vent fan, the fuse will be ignited and will controllably transfer fire from the top of stove 20 to the interior of container 30. The container 30 and the gun powder serve as a releasing means. When the powder within container 30 is ignited by fuse 34, fusible link 24 is severed releasing toggle bolt 27 from valve 12. Lever 28 and valve 12 are displaced by spring 26 into the open position causing the contents of fire extinguisher 10 to be discharged. The contents of fire extinguisher 10 are discharged through manifold 18 and nozzles 22 over the upper surface of stove 20. Stove top fires are thus readily detected by the pyrotechnic sensor means which includes container 30, the powder therein, housing 32 and fuse 34.

It will be apparent to those skilled in the art that the disclosed automatic stove top fire extinguisher may be modified in numerous ways and may assume many embodiments other than the preferred forms specifically set out and described above. For example, many materials other than nylon cord my be used in place of fusible link 24. Accordingly, it is intended by the appended claims to cover all such modifications of the invention which fall within the true spirit and scope of the invention.

I claim:

1. A fire extinguishing system automatically actuated in response to flames from a fire on the upper surface of a stove having a vent hood, comprising:

a. a pressurized fire extinguisher having a lever actuated valve biased to the closed position, said extinguisher including a supply of fire extinguishing material;

b. a discharge manifold coupled to the valve of said fire extinguisher and having a nozzle positioned within the vent hood for distributing the fire extinguishing material from the extinguisher over the upper surface of the stove when said valve is in the open position;

c. a fusible link coupled to said valve for maintaining said valve in the closed position;

d. means coupled to said valve for biasing said valve to the open position;

e. a fuse coupled to said fusible link and extending through the vent hood into an area above the upper surface of the stove for controllably transferring fire from the vent hood to said fusible link; and f. a container of flammable material coupled to said fusible link and to said fuse for severing said fusible link when ignited by said fuse and permitting said biasing means to open said valve to discharge the contents of said extinguisher through said manifold into the area above the upper surface of the stove.

2. A fire extinguishing system automatically actuated in response to flames from a fire on the upper surface of a stove having a venthood, comprising:

a. a pressurized fire extinguisher having a lever actuated valve including a pair of lever arms, said valve being biased to the closed position and including a supply of fire extinguishing material;

b. a discharge manifold having a nozzle positioned in the venthood and being coupled to the valve of said extinguisher for distributing the fire extinguishing material over the upper surface of the stove when said valve is in the open position;

c. a spring coupled to said valve for biasing said valve to the closed position;

d. a toggle link having a pair of folding legs positioned between the lever arms of said valve to maintain said valve in the closed position;

e. a fusible link having one end coupled to said valve and a second end coupled to said toggle link for maintaining the legs of said toggle link in the unfolded, extended position;

f. a housing coupled to said fusible link and including a supply of combustible powder; and g. a fuse coupled to said housing and extending through the venthood into an area above the upper surface of the stove for controllably transferring fire from the venthood to said housing to ignite the powder within said housing and sever said fusible link allowing said spring to collapse the folding legs of said toggle link and thereby permitting said valve to be biased to the open position to discharge the contents of said extinguisher through said manifold onto the upper surface of the stove.

3. In a fire extinguishing system including a container of fire extinguishing material having an opening remotely located from an area to be protected from a fire;

a valve coupled to the opening in said container and having a normally closed position and an open position for selectively discharging material from said container when said valve means is in the open position;

means for transferring the fire extinguishing material from said container to the area to be protected from fire;

an automatic actuator comprising:

a. means coupled to said valve means for biasing said valve means to the open position;

b. a fusible link coupled to said valve for maintaining said valve in the closed position;

c. a container of flammable material coupled to said fusible link; and d. a fuse coupled to said container and extending into the area to be protected from fire for controllably transferring fire from the protected area to said container for igniting the flammable material to sever said fusible link and to permit said biasing means to open said valve and thereby discharge the contents of the extinguisher through the transferring means.

4. A fire extinguishing system automatically actuated in response to flames from a fire on the upper surface of a stove having a vent hood, comprising:

a. a pressurized container of fire extinguishing material having an opening;

b. a valve coupled to the opening in said container and having a normally closed position and an open position for selectively discharging the material from said container when said valve means is in the open position;

c. means coupled to said valve means for biasing said valve means to the open position;

d. means coupled to said valve means for distributing material from said container over the upper surface of the stove when said valve means is open;

e. a fusible link coupled to said valve for maintaining said valve in the closed position;

f. a container of flammable material coupled to said fusible link; and g. a fuse coupled through a conduit to said container of flammable material and extending into the area above the upper surface of the stove for controllably transferring fire from the area below the container of flammable material for igniting the flammable material to sever said fusible link to thereby permit said biasing means to open said valve to discharge the fire extinguishing material when a fire exists on the upper surface of the stove.

5. The fire extinguishing system of claim 4 further including a toggle bolt coupled to said fusible link.

* * * * *